United States Patent [19]

Stenlund

[11] 3,947,228

[45] Mar. 30, 1976

[54] MEANS FOR BURNING A LIQUID FUEL

[75] Inventor: Hans Stenlund, Molndal, Sweden

[73] Assignee: Gotaverken Angteknik AB, Goteborg, Sweden

[22] Filed: Jan. 28, 1975

[21] Appl. No.: 544,792

[30] Foreign Application Priority Data

Feb. 19, 1974 Sweden ..... 7402134

[52] U.S. Cl. ..... 431/121; 137/240

[51] Int. Cl.[2] ..... F23D 11/38

[58] Field of Search ..... 137/238, 240; 239/112, 239/113; 222/148; 431/121, 3, 29

[56] References Cited

UNITED STATES PATENTS

| | | | |
|---|---|---|---|
| 709,302 | 9/1902 | Case | 137/238 |
| 3,674,205 | 7/1972 | Kock | 239/112 |
| 3,766,942 | 10/1973 | Delatronchette et al. | 431/29 |

*Primary Examiner*—Carroll B. Dority, Jr.
*Attorney, Agent, or Firm*—Holman & Stern

[57] ABSTRACT

Waste liquor obtained when pulping wood can be advantageously burned and used for raising steam, while simultaneously chemicals are reclaimed. Certain waste liquors have a noted tendency to cause deposits in valves and piping, which therefore must be intermittently washed by a neutral fluid. This means an interruption of the supply of fuel to the burner, and even if a furnace usually is provided with several burners the interruption causes a disturbance of the steam production, beside necessitating a considerable amount of labor.

The invention proposes a means for supplying liquid fuel and washing fluid simultaneously to each burner by two parallel conduits in such a manner that a simple switch-over will result in the (occasional past) supply conduit and the major part of the burner will be washed, while liquid fuel is supplied through a conduit having recently been washed.

1 Claim, 1 Drawing Figure

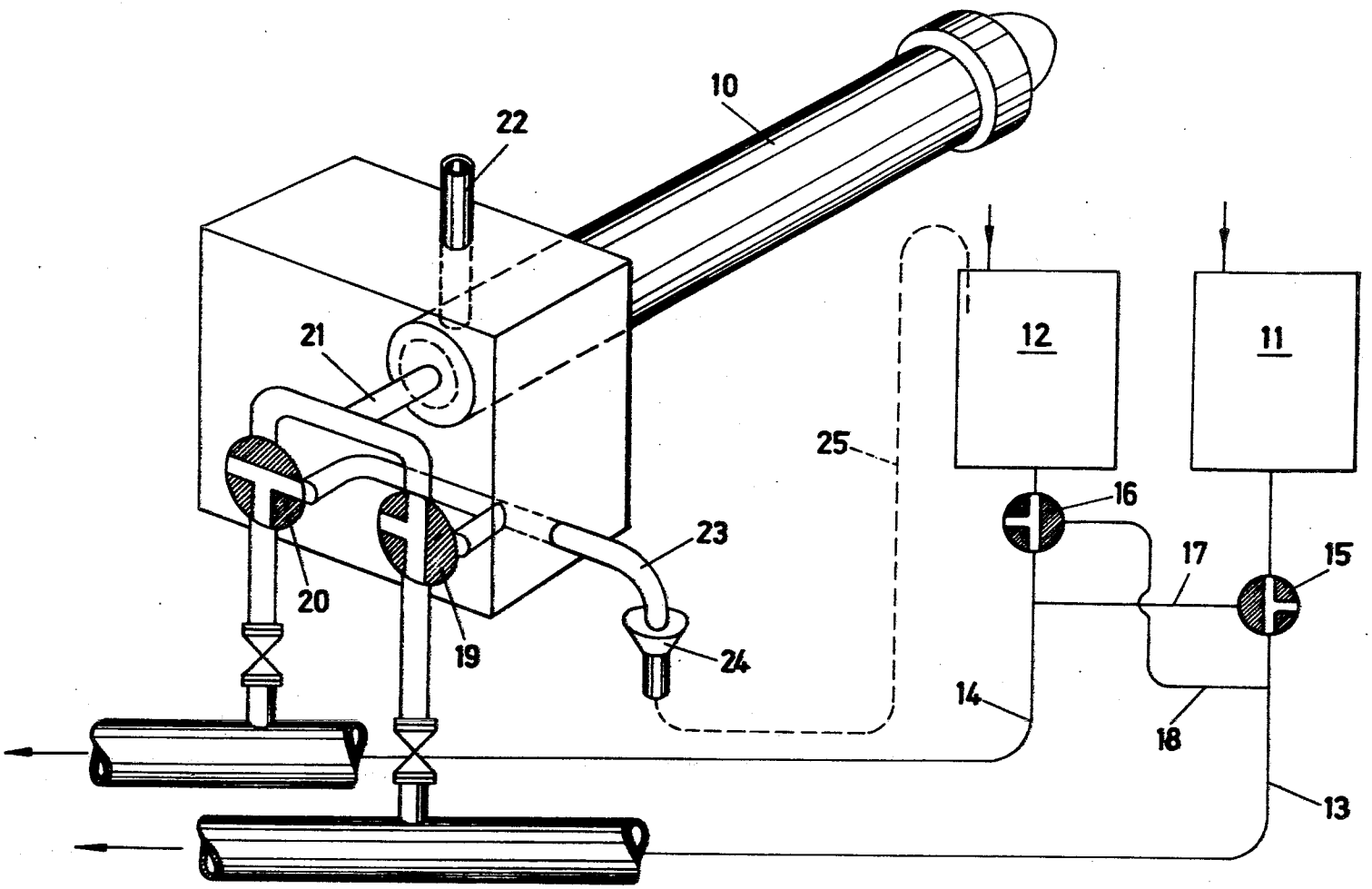
11
12
13
14
15
16
17
18
19
20
21
22
23
24
25
10

MEANS FOR BURNING A LIQUID FUEL

BACKGROUND OF THE INVENTION

The present invention refers to means for burning liquid fuels of the hing having a tendency to cause deposits in conduits and fixtures, and where there are seasons to fear operational disturbances caused by such deposits. Such fuels are for instance found among the waste liquors produced when pulping wood.

When burning sulphite liquor from the magnesium or calcium process in recovery furnaces two separate supply conduit systems are usually provided for feeding the burners, one of said conduits being used to transport the waste liquor, while the other is washed by a fluid (usually acid water). After a certain period of time (usually 8 hours) the two systems are switched over in such a manner that the liquor in the first system is substituted by washing fluid, and the washing fluid in the second system is substituted by liquor.

This is necessary in order to prevent the formation of such thick deposits, which would be the result if one conduit was used to transport liquor for too long a time. At each burner there is branch conduit, which is connectable to both main conduits and may be switched over to the main contuit occassionally supplying liquor while being disconnected to the conduit transporting washing fluid.

In order to wash the branch conduit as well as the burner connected thereto it has hitherto been necessary to disconnect the burner, to remove the lance body and to substitute the latter by a fitting connected to a hose, which in turn is connected to a return flow conduit. Thereafter the washing fluid is made to flow through the burner head and the branch conduit to the return flow conduit. The system including the branch conduit and the burner head is usually washed during 8 hours. With a furnace provided with twelve burners it is common praxis to disconnect two burners simultaneously, which means that each burner will operate for two days between washings. During such a period the deposits formed will build up to such amounts that they will noticeably reduce the free flow area and thus also the capacity of the burner. It is evident that the lance body may easily be substituted by a clean one at any time.

SUMMARY OF THE INVENTION

According to the present invention a means is proposed for burning fuel of the type referred to above, where the burner head is connected to two main supply conduits and includes two three-way valves fitted adjacent to the lance body, as well as a return flow conduit for washing fluid, the arrangement permitting the lance body to be connected to be main conduit momentarily supplying fuel by way of one of the three-way valves, while the other three-way valve connects the second main supply line, momentarily transporting the washing liquid, with the return flow conduit.

All burners may then be practically continuously operated, which means that the total number of burners may be reduced. There are further less risks of the burner head and adjacent parts of the system being clogged, as the time between washings will be considerably reduced, for instance from the two days mentioned, to about 8 hours.

BRIEF DESCRIPTION OF THE DRAWING

One embodiment of the invention will below be described with reference to the accompanying drawing which schematically shows an arrangement according to the invention.

DESCRIPTION OF A PREFERRED EMBODIMENT

The invention is used at a recovery furnace adapted to burn magnesium bisulphite liquor and it is presupposed that a number of burners 10 are fitted in the walls of said furnace.

There is a first tank 11 containing the magnesium waste liquor and a second tank 12 for a washing fluid. The system further includes pumps (not shown) for transporting the liquor and the washing fluid, respectively, as well as governing and supervision devices of conventional kind used with plants of this type.

Two parallel main supply conduits 13 and 14 run between the tanks and the burners and in these conduits there are immediately downstream of the tanks a first set of three-way valves 15 and 16, respectively. A cross conduit 17 is provided between three-way valve 15 and main conduit 14 downstream of valve 16 therein. From the latter a corresponding cross conduit 18 runs to conduit 13, downstream of valve 15.

These first three way valves are operated in such a manner that they, in use, will occupy the positions shown in the drawing for supplying liquor or fluid, respectively, through the conduit in which they fitted, or alternatively, by way of the cross connections, through their opposite main conduits.

At each burner 10 there is a second set of three-way valves 19 and 20, one fitted in each main conduit 13 and 14, respectively and adapted to connect the pertaining main conduit with a passage 21 in the burner head which conveys the liquor through the burner lance body to the nozzle thereof. The burner further is supplied with steam for automization of the liquor by way of a conduit 22, the steam having a somewhat higher pressure than the liquor.

An effluent pipe 23 is connected to both three-way valves 19 and 20. The effluent pipe ends over an open funnel 24, which is the starting point of a return flow conduit 25 which conveys the washing fluid back to tank 12.

This second set of three-way valves is operated in such a manner that the valves will always occupy opposite position, i.e. one of them will, in one position, permit flow from the pertaining conduit 13 to the burner, while the other valve permits flow from the pertaining conduit 14 to the return flow conduit 23-25, and in the other position permits flow from the said main conduit to the return flow conduit and to the burner, respectively.

In the position shown waste liquor from tank 11 is supplied to the burner by way of main conduit 13 and valve 19, while simultaneously washing fluid flows through conduit 14 by way of valves 16 and 20 back to tank 12.

If now the first set of three way valves 15 and 16 are switched over, waste liquor will flow through main conduit 14, while main conduit 13 will convey washing fluid. The second set of valves will then also be switched over and waste liquor will flow through the burner passage 21 by way of valve 20. Simultaneously washing fluid will pass to effluent pipe 23 by way of valve 19.

In this manner the conduits to and including the burner head will be efficiently washed. The second set of three-way valves 19, 20 are built into the burner head, where the non-washed parts of the system will be very short. The lance body is connected to the burner head by a clutch permitting a rapid disconnection. At certain intervals a lance body is removed, substituted by a reserve lance body, and then washed separately.

It should be mentioned that the drawing is schematic only, and that in the actual embodiment the distance between the second set of valves and the lance body is proportionally much shorter than has been shown in order to explain the connections.

The main conduits 13 and 14 are connected to further burners at the same furnace, and are operated in the same manner as has been described above.

What I claim is:

1. In a means for burning a liquid fuel of the kind having a tendency to cause deposits, said means including a first storage tank for the liquid fuel, a second storage tank for a washing fluid, at least one burner having a head and an elongated lance body attached thereto, two main supply conduits running from the two storage tanks to said burner, and valve means for connecting at will the said main supply conduits to said storage tanks in such a manner that any of said supply conduits will convey liquid fuel, while the other supply conduit simultaneously conveys washing fluid, the improvement that the burner head is connected to the two main supply conduits and includes two three-way valves fitted adjacent to the lance body, as well as a return flow conduit for the washing fluid, the arrangement permitting the lance body to be connected to the main conduit momentarily supplying fuel by way of one of the three-way valves, while the other three-way valve connects the second main supply conduit, momentarily transporting the washing liquid, with the return flow conduit.

* * * * *